US007861775B2

(12) United States Patent
Palmer et al.

(10) Patent No.: US 7,861,775 B2
(45) Date of Patent: Jan. 4, 2011

(54) CASING PATCH

(75) Inventors: Larry Thomas Palmer, Spring, TX (US); Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 11/713,976

(22) Filed: Mar. 5, 2007

(65) Prior Publication Data

US 2008/0217000 A1 Sep. 11, 2008

(51) Int. Cl.
*E21B 23/00* (2006.01)
*E21B 33/13* (2006.01)

(52) U.S. Cl. ..... 166/207; 166/277

(58) Field of Classification Search ..... 166/207, 166/277

See application file for complete search history.

(56) References Cited

U.S. PATENT DOCUMENTS 3,358,760 A * 12/1967 Blagg ..... 166/277
3,713,675 A * 1/1973 White, Jr. ..... 285/3
4,660,863 A * 4/1987 Bailey et al. ..... 285/123.6
5,404,944 A * 4/1995 Lynde et al. ..... 166/117.7
5,507,343 A * 4/1996 Carlton et al. ..... 166/277
5,829,524 A * 11/1998 Flanders et al. ..... 166/277
6,622,789 B1 * 9/2003 Braddick ..... 166/277
6,814,143 B2 * 11/2004 Braddick ..... 166/277
6,896,049 B2 5/2005 Moyes
2004/0159445 A1 * 8/2004 Hazel et al. ..... 166/382

OTHER PUBLICATIONS

Tallin, A.G., et al.; "A Fitness for Purpose Assessment of the Use of a Modified Expandable Casing Patch As a Barrier Against H2S Exposure"; AADE 2005 National Technical Conference and Exhibition; Houston, TX; Apr. 5-7, 2005; 6 Pgs.

Weatherford Fishing and Rental Tool Services; "Homco Internal Steel Liner Casing Patch"; Brochure 10.00; Copyright 1995; 4 Pages.

* cited by examiner

*Primary Examiner*—William P Neuder
(74) *Attorney, Agent, or Firm*—Cantor Colburn LLP

(57) ABSTRACT

A casing patch includes a deformable seal configurable to a deformed and undeformed position for sealing and unsealing respectively with a target stub and a pressure based subsystem in operable communication with the deformable seal. The patch may also contain a stop ring to prevent overcompression of the seal.

22 Claims, 2 Drawing Sheets

CASING PATCH

BACKGROUND

Casing patches have long been used in the hydrocarbon recovery industry in conjunction with a repair to a tubing or casing segment in a wellbore. It will be understood that the term "casing patch" as used herein is intended to relate to both patches actually in the casing of a wellbore and patches that are in a tubing string for a wellbore.

It is to be assumed for purposes of this disclosure that a faulty section of casing or tubing has already been cut out of the well and the "stub", i.e., the piece left downhole, and to which the casing patch will be connected, has been dressed.

Prior art casing patches have included Chevron seals and lead based seals but these have drawbacks such as damage to the Chevron type seals during engagement with the stub as they are exposed to the sharp edge thereof and such as the one time operation of the lead seal type, among other things.

SUMMARY

A casing patch includes a deformable seal configurable to a deformed and undeformed position for sealing and unsealing respectively with a target stub and a pressure based subsystem in operable communication with the deformable seal.

A casing patch includes a body, at least one slip system at the body, at least one seal actuatable in response to actuation of the slip system and a stop ring located at the seal to prevent overcompression thereof.

BRIEF DESCRIPTION OF THE DRAWINGS

Referring now to the drawings wherein like elements are numbered alike in the several Figures.

DETAILED DESCRIPTION

In order to enhance understanding of the invention applicants have elected to describe briefly the components of the tool followed by a discussion of its operation.

Figure 1:
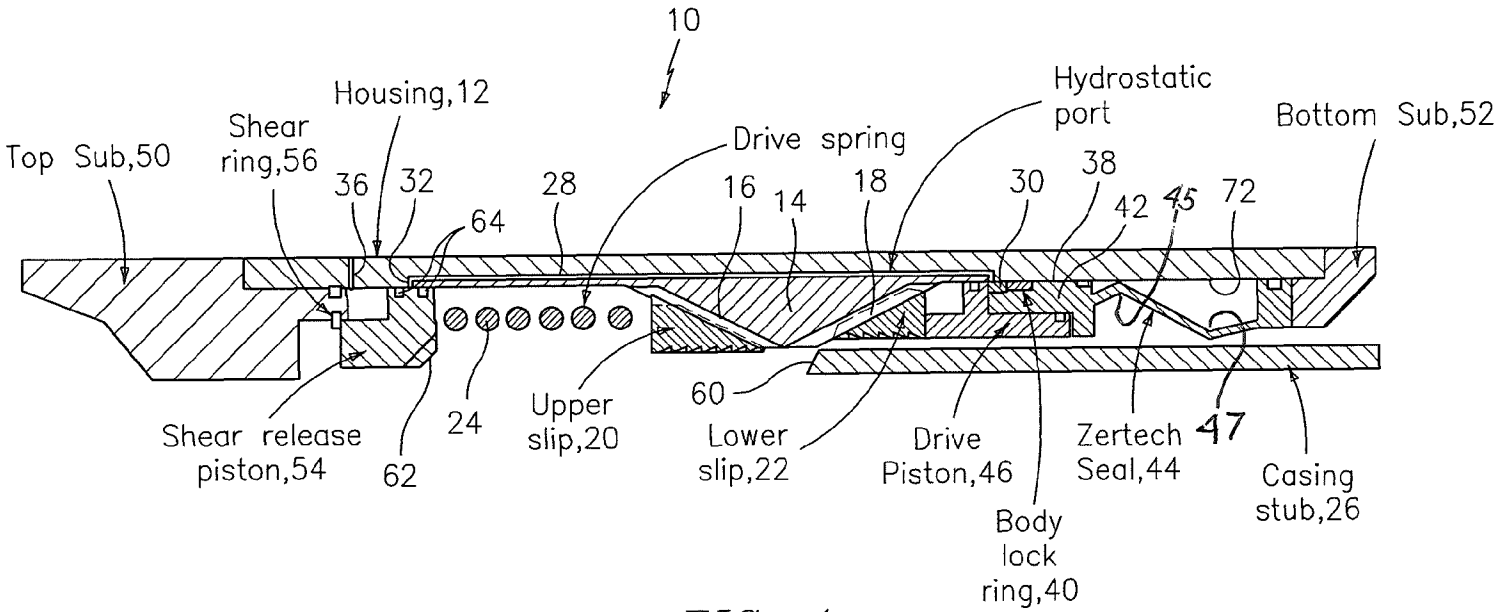
FIG. 1 is a schematic quarter section view of a casing patch in an unactuated position.

Referring to FIG. 1, a casing patch 10 as disclosed herein is illustrated in an unactuated position. It is in this position that the device is stored and run in the hole prior to engagement with a stub (introduced and numbered hereunder) in a wellbore.

The patch 10 comprises a housing 12 that includes several features. One of the features is an anchor system comprising slip ramp 14 extending from housing 12. The ramp 14 is in one embodiment a unitary structure of the housing and includes two ramp faces 16 and 18. These, in the illustrated embodiment are generally frustoconically shaped and are configured to complementarily guide and support a plurality of slips. It is to be understood that at least one of the plurality of slips will hold in an uphole direction (uphole slips 20), and at least one of the plurality of slips will hold in the downhole direction (downhole slips 22), when actuated. The slips may be cut with a left hand thread if desired to promote removal of the patch from the well if desired. In some embodiments of the patch several slips will hold in each direction, when actuated.

In the illustrated embodiment, a biasing member 24, which may be a spring, gas charged member, or another member which itself is driven to extend, urges slips 20 to climb ramp 16 thereby causing slip(s) 20 to move in a direction to bite into a stub 26 with which the patch 10 is to engage. Slips 20 therefore are automatically engaged with the stub 26 when the patch 10 comes in engaging contact therewith.

Another feature of housing 12 is a pressure channel 28 that is formed within the housing 12 as illustrated or may be attached thereto as a separate structure, if desired. The channel 28 has the function of providing a pressure passageway to a volume changeable chamber 70 (seen only in FIG. 2) through port 30, which is connected by channel 28 to inlet port 32.

The housing further includes, as illustrated, a pressure relief port 36 and a toothed section 38 complementary to a body lock ring 40 mounted at an end housing 42 of a seal 44. The body lock ring functions to maintain a compression load on the seal 44 that is created by application of pressure to port 30. Simultaneously as the compression load is applied to the seal, the fluid supplied through port 30 to chamber 70 exerts a driving force on a drive piston 46 to actuate slips 22. Thus it will be appreciated that although the slips 20 are actuated automatically upon engagement with the stub 26, the slips 22 require input from a remote pressure source to actuate.

Additionally connected to the housing 12 a top sub 50 at an uphole end of the housing 12 and a bottom sub 52 at a downhole end of the housing 12.

Further included in the illustrated embodiment of the casing patch 10 is a piston 54 that is moveable from (1) a position in which it inhibits application of pressure to pressure inlet 32 to (2) a position where application of pressure to port 32 is permitted. A release arrangement 56, which may be a shear member, such as for example a shear ring, is installed to restrain movement of the piston 54 until the opportune time. That time comes when the stub 26 is fully engaged by the patch 10 when set down weight of the patch on the stub 26 (taken up by the piston 54) causes the release member 56 to release.

Figure 2:
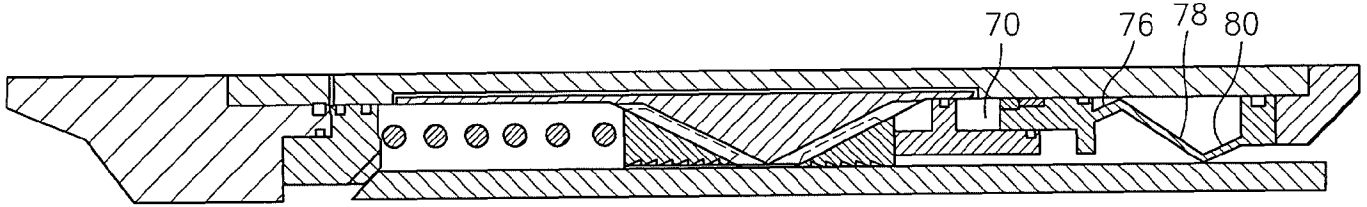
FIG. 2 is a schematic quarter section view of the embodiment of FIG. 1 a casing patch in an actuated position.

Referring now to FIGS. 1 and 2 together, illustrating both a run in and actuated position, respectively, operation of the patch 10 is addressed. Upon running the patch in the hole, the patch encounters stub 26. It is noted that the illustration hereof presents the stub 26 at the inside dimension of the patch 10. It is to be appreciated however that the patch could be constructed inside out and then would engage a stub 26 located at an outside dimension of the patch. The components and general principle of operation are identical for the two concepts. In the illustrated embodiment, a leading edge 60 of stub 26 is enveloped by the advancing patch 10 in a more or less clearance fit until the stub 26 encounters slips 20. Slips 20 are driven somewhat uphole (left in figure) and radially outwardly on ramp 16 by contact with the stub 26 but against the urging of biasing member 24, which as noted above may be of any type including a coil spring as illustrated. Because of the biasing action of the member 24, the slips 20 bite into stub 26 and tend to bite more deeply as well as climb ramp 16 radially inwardly upon a pull uphole on patch 10. Slips 20 thus effectively prevent movement uphole by patch 10, once engaged.

Further downhole movement of patch 10 brings edge 60 into contact with a contact face 62 of piston 54. Contact plus further movement downhole of patch 10 causes a growing load to be placed upon piston 54 and release member 56.

Since piston 54 is releasably retained by release member 56, piston 54 will not move until a predetermined load is reached. Upon the predetermined load being reached however the release member 56 releases. In the illustrated embodiment, since the release member is a shear ring, the ring shears allowing piston 54 to move to the position illustrated in FIG. 2. It should be noted that because biasing member 24 bears against piston 54, consideration must be given to the length of displacement of piston 54 in a given tool to ensure that a sufficient biasing force remains on slips 20 after release of the release member and consequent movement of piston 54.

Upon movement of piston 54, port 32 is newly exposed to hydrostatic pressure having been protected therefrom by piston 54 and seals 64 prior to movement of piston 54. Since hydrostatic pressure (or pressure-up pressure) is calculable or otherwise known for the target depth, the differential pressure needed at the volume changeable chamber 70 illustrated in FIG. 2 is calculable. It is to be appreciated that what is necessary is that the applied fluid pressure through channel 28 be higher than the environmental pressure surrounding chamber 70 so two movements occur. The movements are simultaneous in an uphole direction for the drive piston 46 (moving uphole) and in a downhole direction for the seal end housing 42 (moving downhole). These movements, in turn, cause certain desirable functions of the patch to occur. The driver piston 46 urges downhole slip(s) 22 to climb ramp 18 moving thus radially inwardly of the housing 12 and uphole to engage the stub 26 and prevent or significantly retard downhole movement of the patch 10 relative to the stub 26. Simultaneously, end-housing 42 loads the seal 44 to cause engagement with the stub 26 due to an opposite end of the seal 44 being blocked from movement downhole by bottom sub 52. A seal is also maintained at an inside surface 72 of housing 12. It is to be noted that because seal 44 is a clearance fit while initially engaging the stub 26, it is not subject to damage during original engagement of stub 26. The sealing action is maintained against both the stub 26 and the housing inside surface 72 by the movement inhibiting action of the body lock ring 40 against threads 38 in the housing 12. In this condition, the seal is maintained indefinitely and the patch is secured.

In one embodiment the seal is a metal seal, which then forms a metal-to-metal seal between the patch and stub when actuated. In such embodiment, high pressure differentials are easily supported. It is to be understood however that if desired, an elastomeric material or other seal material could be substituted in the patch disclosed. In one metal seal embodiment, three sections 76, 78, 80 (as shown) are utilized and are disposed in angular position relating to one another. This configuration facilitates deformation of the seal into an actuated position when subjected to compressive load. Alternatively, the seal may have a more cylindrical configuration and include lines of weakness in the material of the seal. Effective lines of weakness 45 and 47 (119 in the FIGS. 3 and 4 embodiment) are positioned at an inside apex of a deformation site (a place where the metal is angularly configured as shown) such that if the line of weakness is a groove, the groove would close upon actuation of the seal; or if the line of weakness is material weakness based, the material would flow to allow the same movement direction to be achieved. Embodiments of metal-to-metal seals that may be utilized in the casing patch described herein include those disclosed in U.S. Pat. No. 6,896,049 to Moyes, which is incorporated herein in its entirety by reference.

Alluded to above is the ability the system has to be removed from the well. This is possible in one embodiment by the provision of slip teeth that are left hand threads. If such has been manufactured into the patch, then neutral weight and right hand torque, will effectively unscrew the patch from the stub 26 thereby allowing retrieval of the patch to surface or to another location.

Figure 4:
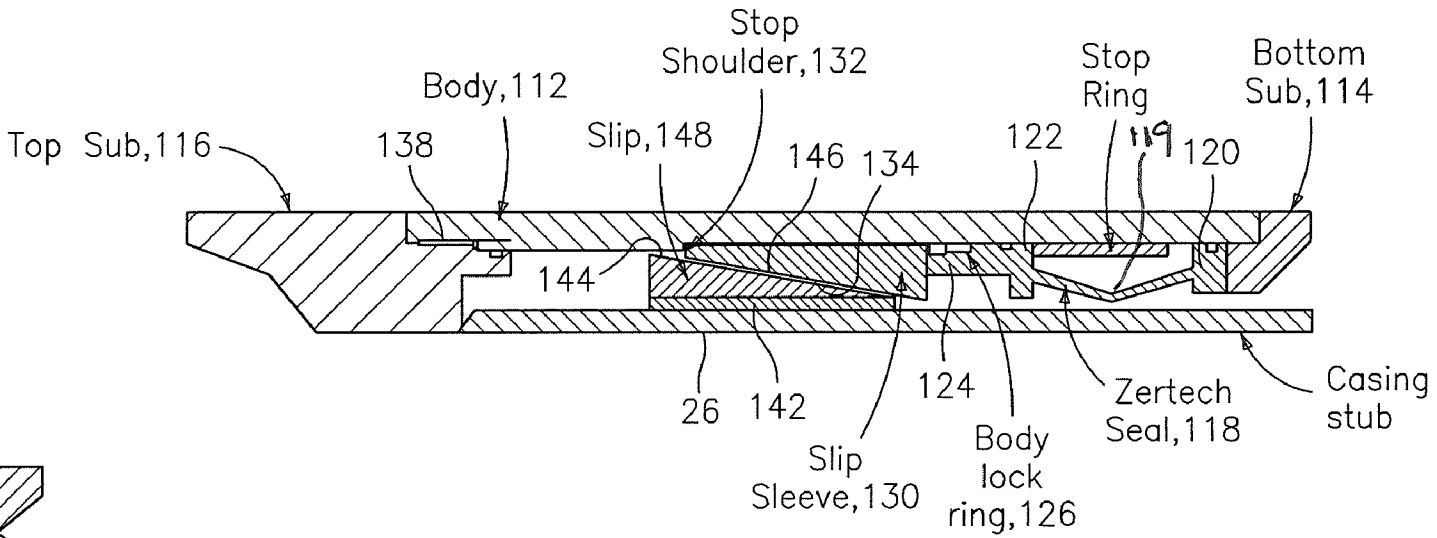
FIG. 4 is a schematic quarter section view of the embodiment of FIG. 3 in an actuated position.
Figure 3:
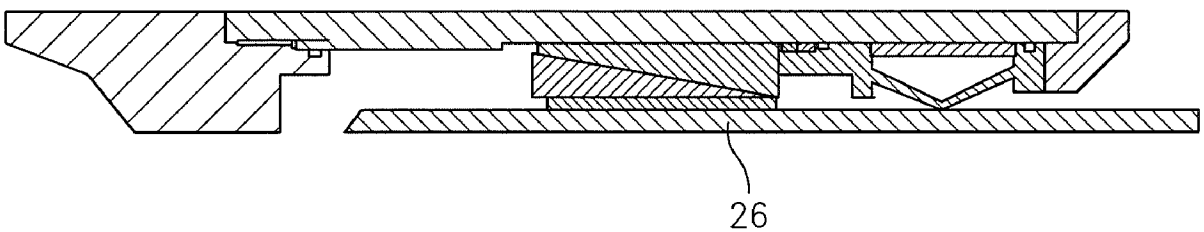
FIG. 3 is a schematic quarter section view of another embodiment of a casing patch in an unactuated position.

In another embodiment, referring to FIGS. 3 and 4, stub 26 will be recognized from FIGS. 1 and 2 but the balance of that illustrated in FIGS. 3 and 4 is different. The casing patch 110 embodiment of FIGS. 3 and 4 includes a body 112, attached to which is a bottom sub 114 and a top sub 116. Adjacent bottom sub 114 is a seal structure 118, which may as in previously discussed embodiment be a metal-to-metal seal and may in some embodiments be as disclosed in the '049 patent previously incorporated herein by reference. Seal structure 118 includes end housings 120 and 122, the latter of which is inclusive of a body lock ring groove 124 that is receptive to a body lock ring 126. The body lock ring 126 is interactive with a ratchet thread 128 located appropriately (as shown) on an inside dimension of the body 112. Ring 126 is configured to ratchet along ratchet thread 128 in a direction causing seal 118 to be energized and then held in that position. Seal 118 further includes a stop ring 129 to physically prevent over compression of the seal 118.

Adjacent end housing 122 is positioned a slip sleeve 130 which is movably disposed at the inside dimension of the body 112. Sleeve 130 is positioned between ratchet thread 128 and a stop shoulder 132 provided at the inside dimension of body 112. The shoulder 132 may be integrally formed as shown or may be created with a device such as a snap ring, etc.

Slip sleeve 130 further includes an angled face 134 that is configured to "slip" in one direction and "stick" in the opposite direction. In the event a thread is used as the surface feature that causes the slip and stick, then the sleeve 130 may be backed off and the casing patch retrieved by "unscrewing" the same using right or left hand rotation of a string (not shown) as appropriate. The top sub 116 is attached to body 112 at an uphole end thereof by suitable connection such as a thread 138.

Finally, the casing patch 110 includes a slip 140 and friction pad 142. The pad 142 is configured to tightly grip against the target stub 26 while the slip interacts with angled face 134 through its own angular surface 144. Slip 140 is further possessed of a ratcheting arrangement 146 at the interface of surface 144 and face 134 such that movement occurs relative to sleeve 130 in one direction but is inhibited in the opposite direction.

Figure 5:
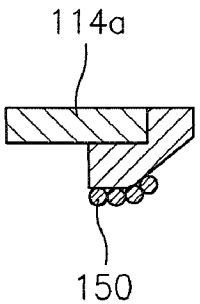
FIG. 5 is a view of an alternate bottom sub with dressing features.

In operation, this embodiment of a casing patch 110 is run on a string (not shown) to depth to interact with stub 26. It is to be appreciated that stub 26 may be previously dressed conventionally or may be dressed at the same time as the casing patch 110 is being run if the casing patch is configured with an alternate bottom sub **114*a* (shown in FIG. 5). Sub 114*a* includes as illustrated carbide or other similar hard material abrasive elements 150 that are capable of machining the stub 26**, during run-in rotation, to a precise outside diameter to ensure appropriate sealing thereto.

Whether dressed in a separate run or dressed simultaneously, the casing patch 110 is run over the stub 26 until top sub 116 comes into contact with stub 26 at edge 60 thereof. This is the position illustrated in FIG. 3 prior to actuating the patch. Once casing patch 110 is fully seated (as illustrated in FIG. 3) and the slip 140 is urged into engagement with the stub and the slip sleeve 130 by stop shoulder 132 (and the resilient nature of the slip in the radial direction due to longitudinal cuts alternating from the top and bottom of the slip, not specifically shown), the patch is pulled uphole. The uphole pull causes the slip sleeve 130 to leave contact with stop shoulder 132 as it moves toward bottom sub 14 due to the slip 140 being "stuck" to the stub 26. The movement of slip sleeve 130 toward bottom sub 114 causes a shortening of the dimension between sleeve 130 and sub 114 thereby impacting the available axial space for seal 118. Seal 118 is thus compressively axially loaded between sub 114 and sleeve 130 thereby deforming the same into contact with stub 26. The deformation is intended to and is capable of creating a high-pressure seal with stub 26. In the event seal 118 is metal it is as described hereinbefore, the resulting seal is a metal-to-metal seal. Axial loading on the seal 118 is ensured by the body lock ring 126 acting upon thread 128 due to being forced therealong by sleeve 130. Comparison of FIGS. 3 and 4 side-by-side will complement the immediately foregoing discussion of the operation of the device.

What is claimed is:

1. A casing patch comprising:

a deformable metal seal having a plurality of lines of weakness that predispose the seal to deform in a selected direction, the seal being configurable to a deformed and undeformed position for sealing and unsealing respectively with the target stub;

a pressure based subsystem having a first position where fluid pressure is blocked from a fluid pressure port in the subsystem prior to engagement of the casing patch with a target stub and a second position where fluid pressure is not blocked from the fluid port, the second position being achieved only subsequent to engagement of the casing patch with the target stub.

2. The casing patch as claimed in claim 1 wherein the pressure-based subsystem is responsive to contact with the target stub to automatically apply pressure to deform the seal.

3. The casing patch as claimed in claim 2 wherein the subsystem includes a piston positioned to inhibit the application of pressure to the seal, the piston being displaceable by contact with the target stub.

4. The casing patch as claimed in claim 3 wherein the subsystem includes a release member to releaseably restrain the piston in the position to inhibit application of pressure.

5. The casing patch as claimed in claim 1 wherein the patch further comprises an anchor system.

6. The casing patch of claim 5 wherein the anchor system includes a plurality of slips, at least one of the plurality of slips configured to hold in an uphole direction and at least of the plurality of slips being configured to hold in a downhole direction.

7. The casing patch as claimed in claim 6 wherein the at least one of the plurality of slips is configured with a left hand thread.

8. The casing patch as claimed in claim 6 wherein the at least one slip configured to hold in the uphole direction is spring biased to engage a target stub.

9. The casing patch as claimed in claim 6 wherein the at least one slip configured to hold in a downhole direction is pressure actuated.

10. The casing patch as claimed in claim 8 wherein the pressure is hydrostatic pressure.

11. The casing patch as claimed in claim 8 wherein the pressure is automatically applied upon contact between the pressure-based subsystem of the patch and the target stub.

12. The casing patch as claimed in claim 1 wherein the pressure-based subsystem is further in operable communication with at least a portion of an anchor system.

13. The casing patch as claimed in claim 11 wherein the at least a portion of the anchor system is actuated upon displacement of a piston from a position inhibiting application of pressure to the at least a portion of the anchor system.

14. The casing patch as claimed in claim 11 wherein the seal and the at least a portion of the anchoring system are maintained at a sub hydrostatic pressure environment.

15. The casing patch as claimed in claim 11 wherein the at least a portion of the anchoring system is a drive piston.

16. A casing patch as claimed in claim 1, further comprising:

a body;

at least one slip system at the body;

a stop ring located at the seal to prevent overcompression thereof.

17. The casing patch as claimed in claim 16 wherein the stop ring extends from one end housing to the other end housing of the seal when the seal is fully compressed.

18. The casing patch as claimed in claim 16 wherein the body includes a ratchet and the seal includes a body lock ring engaged therewith.

19. The casing patch as claimed in claim 16 wherein the body includes a stop shoulder maintaining at least a portion of the slip system in place during run-in.

20. The casing patch as claimed in claim 16 wherein the slip system includes a slip sleeve and a slip, having opposed angular interconnecting surfaces.

21. The casing patch as claimed in claim 20 wherein the surfaces further includes ratcheting profiles complementary to each other.

22. The casing patch as claimed in claim 16 wherein the seal is a metal-to-metal seal.

* * * * *